United States Patent [19]

Gense

[11] 4,141,488

[45] Feb. 27, 1979

[54] CENTRIFUGE

[75] Inventor: Johannes P. Gense, Meerssen, Netherlands

[73] Assignee: Koninklijke Nederlandse Papierfabrieken N.W., Maastricht, Netherlands

[21] Appl. No.: 825,761

[22] Filed: Aug. 18, 1977

[51] Int. Cl.[2] ..... B04B 1/20; B04B 9/10

[52] U.S. Cl. ..... 233/7; 233/24

[58] Field of Search ..... 233/23 R, 24, 7; 318/337, 327, 338

[56] References Cited

U.S. PATENT DOCUMENTS

| | | | |
|---|---|---|---|
| 3,494,542 | 2/1970 | Craig et al. | 233/7 |
| 3,734,399 | 5/1973 | Oas | 233/7 |
| 3,851,819 | 12/1974 | Tadokoro | 233/24 |
| 3,923,241 | 12/1975 | Cyphelly | 233/24 |
| 3,950,684 | 4/1976 | Peterson | 318/338 |
| 4,019,107 | 4/1977 | Dixon et al. | 318/338 |

*Primary Examiner*—George H. Krizmanich

*Attorney, Agent, or Firm*—Strauch, Nolan, Neale, Nies & Kurz

[57] ABSTRACT

A centrifuge for separating liquid and solid materials, comprising an outer drum and an inner drum formed as a worm conveyor. Control means are provided for maintaining a set speed differential between the outer drum and the inner drum at a constant value through a proportional action, and in addition to the proportional action performing a corrective control action on the speed differential upon variation of the torque required.

3 Claims, 2 Drawing Figures

CENTRIFUGE

Figure 1:
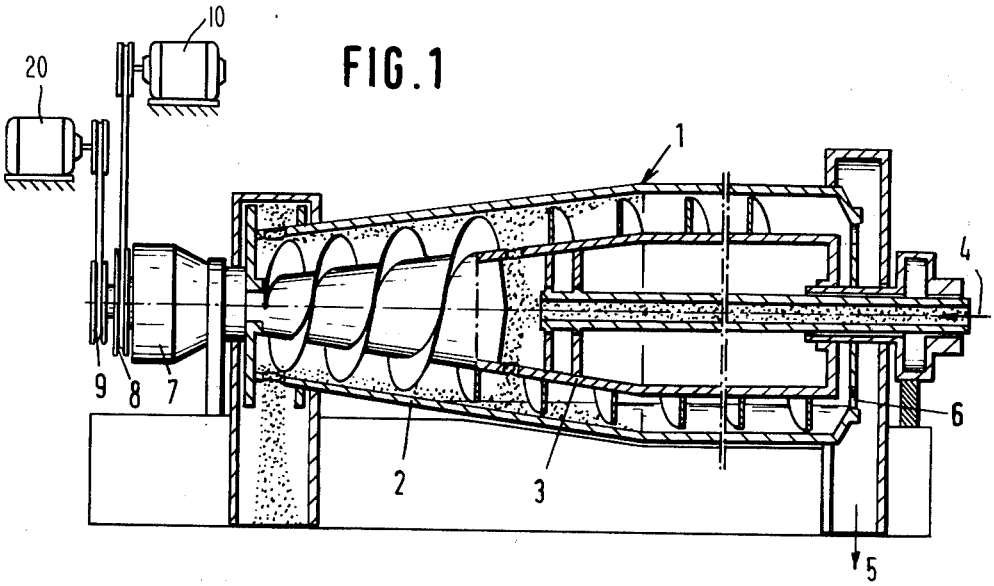

This invention relates to a centrifuge for separating liquid and solid materials, which comprises an outer drum and an inner drum formed as a worm conveyor.

For certain purposes it is of importance that the dry matter leaves the centrifuge in as dry a condition as possible. This requires a relatively long residence time in the centrifuge. This residence time is determined by the rate of transport and hence by the difference in speed between the inner drum and the outer drum. Hereinafter it will be assumed that the centrifuge is so arranged that transport is effected in the correct direction if the inner drum rotates faster than the outer drum. It will be clear that the centrifuge can also be arranged to effect transportation of the sedimentation if the outer drum rotates faster than the inner drum.

According as the difference in r.p.m. between the inner drum and the outer drum is greater, the solid matter is transported through the machine at a higer rate, and the moisture content of the solids leaving the centrifuge is higher. Accordingly, the aim is for the smallest possible difference in speed between the inner drum and the outer drum in order that the resulting solid matter may be as dry as possible. In the past, the desired difference in r.p.m. has been set at an experimentally determined value that was as low as possible. This, however, led to the inner drum becoming jammed owing to an accumulation of solids upon undue variation in the process parameters applying when the value was set.

Centrifuge industries are attempting to solve these problems by using a hydraulic motor rotating along with the outer drum, which motor, through gearing, gives the inner drum, i.e. the worm conveyor, a slightly higher speed. The speed differential control realized in this way is a so-called two-point control, effectuated through the oil pressure. The stroke frequency depends on the load factor of the centrifuge and the adjusted band width of the control; a pendulating or cyclic speed differential between drum and worm causes a fluctuating and also a lower dry content.

It is an object of the present invention to provide a solution for the above problem.

According to the present invention, there is provided a centrifuge for separating liquid and solid materials, comprising an outer drum and an inner drum formed as a worm conveyor, characterized by control means for keeping a set speed differential between said outer drum and said inner drum at a constant value through a proportional action, and in addition to said proportional control action performing a corrective control action on the speed differential upon variation of the torque required.

According to a further elaboration of the present invention, there is provided an electrical machine operating as a generator, which is driven by a pulley coupled with one drum, the speed of the generator being converted via a tachogenerator into a signal for proportional speed control, which after comparison with the set value for the speed differential provides a target value for the current of the generator, and in which a signal proportional to the current of the generator is used for the corrective control action.

One embodiment of the invention will now be described, by way of example, with reference to the accompanying drawings. In said drawings, FIG. 1 shows a centrifuge of the type to which the present invention relates; and FIG. 2 shows a control circuit arrangement according to the present invention for use in a centrifuge as shown in FIG. 1.

Figure 2:
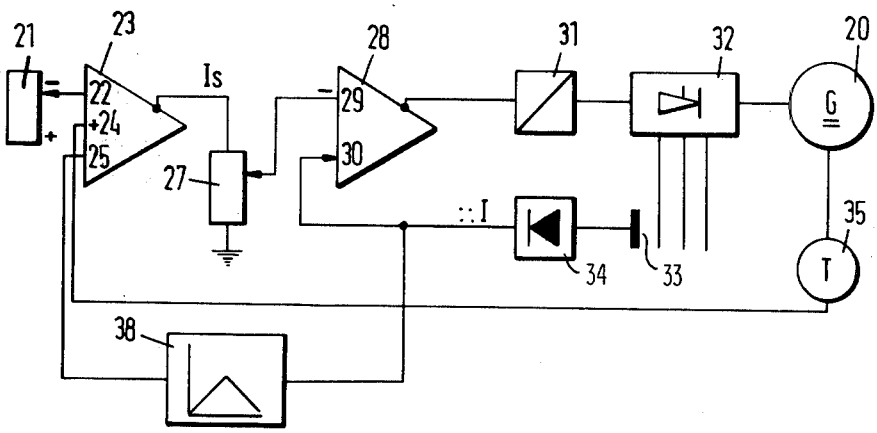

Referring to FIG. 1, there is shown a centrifuge comprising an outer drum 1 with a conical part 2. Disposed within the outer drum is an inner drum 3, also having a conical configuration, and formed as a worm or screw conveyor. Provided at the wide end of the drums is a central supply tube 4, serving to supply a mixture of liquid and solid materials to the centrifuge. At the same end of the drum, there is provided an outlet opening 5 for the discharge of liquid stripped of solids. The liquid level within the drums at which liquid is discharged is determined by an adjustable weir 6.

The centrifuge as shown is driven by a motor 10 through a cam disk reduction gear box 7, which operates in a manner akin to that of a differential and which which is provided with a drum pulley 8 driven by the motor for driving the outer drum, and a worm pulley 9 coupled with the inner drum. In the present case the reducer provides a transmission ratio of 25 : 1 so that when the speed of the drum pulley $n_{dp} = 1600$ revolutions per minute and the speed of the worm pulley $n_{wp} = 1400$ revolutions per minute, the outer drum has a speed $n_d$ of 1600 r.p.m. and the inner drum a speed $n_w$ of $1600 + (1600 - 1400/25) = 1608$ r.p.m. Because $n_w = n_d + n_{dp} - n_{wp}/25$ as shown by the foregoing, deceleration of the worm pulley results in a higher speed of the inner drum and hence to a higher speed differential.

According to the present invention, an electrical machine 20 operating as a generator (FIG. 2) is coupled to the worm pulley, for example, through a belt transmission as shown in FIG. 1 to brake the inner drum in a manner which will keep the differential in speed between it and the outer drum constant.

FIG. 2 shows a control circuit arrangement according to the present invention. The arrangement comprises a potentiometer 21, by means of which a given voltage value can be set, which is supplied to one input 22 of an r.p.m. control amplifier 23. This voltage value corresponds to the speed $n_{wp}$ of the worm pulley. Amplifier 23 has two further inputs 24 and 25, the function of which will be described hereinafter. Amplifier 23 operates as a differential amplifier and also as an inverter amplifier. At the output of amplifier 23 a voltage signal appears, which is supplied through a potentiometer 27 to an input 29 of a second amplifier 28 and serves as a target value Is for the current I from generator 20. To a second input 30 of amplifier 28 a signal proportional to current I is supplied through a feedback loop comprising a converter 31 for converting a voltage into phase differences, a thyristor control device 32, a current transformer 33, and a rectifier 34. The thyristor control device 32 is further coupled to generator 20, which in turn is coupled to a tachogenerator 35 for supplying a signal corresponding to the r.p.m. of generator 20 to input 24 of amplifier 23.

If the signal from the tachogenerator to input 24 is greater than that corresponding to the set r.p.m. of the worm pulley, this means that the r.p.m. of generator 20, and hence of the worm pulley, is too high. Because as a consequence of the intermediate reducer 7 maintains a constant speed ratio between drum pulley 8 and worm pulley 9, this results in too low a speed differential between the outer drum and the inner drum as is apparent from the formula set forth above.

As a consequence of the input voltages applying at inputs 22 and 24, amplifier 23 now provides a higher target value for current I from generator 20, as a result of which generator 20 will begin to decelerate. This also decelerates the worm pulley, so that its speed $n_{wp}$ is decreased and the speed $n_w$ of the inner drum is increased.

It has been found, however, that such a control of the speed differential is not sufficient to prevent jamming. If, at a selected speed differential, the amount or the concentration of the substance to be centrifuged is increased, the transport capacity of the centrifuge is liable to be exceeded: more substance is deposited than expelled, and the substance will form a rigid connection between the drum and the worm.

For this reason the feedback signal supplied to the input of amplifier 28, which signal is proportional to current value I, is also supplied to an integrator 38. The output of this integrator is connected to input 25 of r.p.m. control amplifier 23. Now, an increase in the value of I, through increased sedimentation, temporarily provides an additional input signal to input 25, whereby the target value for I is increased and a temporary additional decrease in the speed of generator 20, and hence of worm pulley 9, occurs, resulting in a higher speed differential between the inner and outer drums.

This additional braking accordingly provides a controlled increase in speed differential between the inner drum and the outer drum to clear the increased supply of substance. This control is continuous, and ensures a non-oscillating r.p.m. differential.

With an increasing input signal, the integrator has a lower time constant than with a decreasing input signal. This ensures the stability of the control circuit.

It is to be understood that various modifications of the embodiment described and shown can be made without departing from the scope of the present invention. Such modifications are to be regarded as forming part of this invention.

I claim:

1. A centrifuge for separating liquid and solid materials, comprising: an elongated, rotatably mounted outer drum; an inner drum with a helical conveyor means thereon mounted in said outer drum for rotation about an axis coincident with the axis of rotation of said outer drum; means for rotating said outer drum; a differential drive so connecting said outer drum and said helical conveyor supporting inner drum that rotation of said outer drum effects rotation of said inner drum at a speed different from the speed of rotation of said outer drum; and means for keeping the differential between the speed of the outer drum and the speed of the inner drum substantially constant, said last mentioned means comprising an electrical generator drive connected in braking relationship to said inner drum and control means for so proportioning the braking effect exerted by said generator to variations in the differential between the speed of the outer drum and the speed of the inner drum as to keep said speed differential substantially constant.

2. A centrifuge as defined in claim 1 wherein said control means comprises tachogenerator means for producing a first signal indicative of the speed of said inner drum, means for comparing said first signal with a second signal indicative of a target speed of the inner drum which will produce the wanted differential between the speeds of the inner and outer drums and for deriving a feedback control signal proportional to the difference between the actual speed of the inner drum and said target speed; and means utilizing said feedback control signal to adjust the speed of said inner drum to said target speed.

3. A centrifuge as defined in claim 2, wherein said control means further includes an integrator means operable when the differential between the speeds of the inner and outer drums reaches a selected magnitude indicative of incipient jamming of the centrifuge to provide a transient modification of said feedback control signal which will produce a reduction in the braking effect exerted by said generator which is greater than that which would be produced by virtue of the unmodified feedback control signal.

* * * * *